United States Patent [19]

Korterod et al.

[11] 4,267,929

[45] May 19, 1981

[54] LID ARRANGEMENT FOR A SKI WAX CAN WITH A TEAR-OFF CASING

[75] Inventors: Lars Korterød, Stokke; Arne Strand, Oslo; Odd Ellingsen; Harry Broen, both of Sem, all of Norway

[73] Assignee: Tubefabrikken A/S, Sem, Norway

[21] Appl. No.: 87,795

[22] Filed: Oct. 24, 1979

[30] Foreign Application Priority Data

Nov. 3, 1978 [NO] Norway ..... 783703

[51] Int. Cl.[3] ..... B65D 3/26; B65D 5/54; B65D 75/70; B43K 19/02

[52] U.S. Cl. ..... 206/603; 220/267; 220/277; 401/96; 401/97; 30/123; 30/411

[58] Field of Search ..... 206/603; 401/96, 97; 220/267, 277; 30/411, 2, 123

[56] References Cited

U.S. PATENT DOCUMENTS

| | | | |
|---|---|---|---|
| 1,532,766 | 4/1925 | Levy | 401/97 |
| 2,300,179 | 10/1942 | Rosen | 401/96 |
| 3,846,029 | 11/1974 | Benn et al. | 401/96 |

*Primary Examiner*—William T. Dixson, Jr.

*Attorney, Agent, or Firm*—Cushman, Darby & Cushman

[57] ABSTRACT

A lid arrangement for a ski wax can with a tear-off casing. Said lid comprising a bottom surrounded by a peripheral skirt adapted to lie against the exterior of the casing. A sharp edge or knife edge is arranged on the interior of the lid at its skirt and facing away from the bottom of the lid. Said edge producing a cut in the upper edge of the can casing when being placed on the can. Said cut facilitating the initial tearing-off of the upper portion of the can casing. The cut produced has a depth preferably equal to the distance between peripheral, parallel score lines provided in the box casing for tearing purposes.

10 Claims, 9 Drawing Figures

LID ARRANGEMENT FOR A SKI WAX CAN WITH A TEAR-OFF CASING

The present invention pertains to a lid arrangement for use on a can for ski wax having a tear-off casing, the lid being of the type defined in the preamble of the appurtenant main claim.

Ski wax cans of the above type have been made of an easily torn material, for example, thin lead; more recently thin aluminum plate, for example, has also been used, which is drawn up to form a cylindrical container. After the container has been filled with ski wax, it is closed with a lid, which can be made either of plastic or metal and which consists of a flat base portion surrounded by a skirt. When using the can of ski wax, one tears off an upper portion of the casing by hand to expose the wax, which is then applied to the sliding surface of the ski.

Even with a material as soft as lead, it may be difficult to tear off the outer margin of the casing in order to expose the wax, and the more rigid the material used (i.e., aluminum), the more difficult this operation becomes. The operation is even more difficult if the user, owing to the weather, has cold, stiff fingers.

Once the user has managed to tear the edge of the casing, the further tearing of the casing circumference occurs in an uncontrolled manner, such that the tear-off line will usually be lop-sided, uncovering larger or smaller sections of the wax. In order to solve the latter problem, it is known in the art to provide parallel, peripheral score lines in the casing, such that a strip of even width will be torn off.

It is also known in connection with this type of tear-off strip casing to provide each strip with an upwardly-projecting tearing tab, as disclosed in Norwegian Patent No. 59.360.

The primary object of the present invention is to provide a lid for a ski wax can by means of which one automatically produces a cut in the upper edge of the casing when one places the lid on the can. It will thus be much easier to tear off an upper section of the casing when the lid is subsequently removed, in that one has merely to insert a fingernail under the edge of the casing at the cut and perform a tearing movement. If the casing is also provided with the above-mentioned, known per se score lines, one can easily tear off an even strip of the outermost section of the casing, providing an even exposure of the wax; this also results in a more economic use of wax, because the wax, especially when it has a relatively soft consistency, is prevented from oozing out at the lower sections of the casing, which occurs when the tearing occurs in an uncontrolled manner.

The above objects are obtained in accordance with the invention by means of the features disclosed in the characterizing clause of the appurtenant main claim and in the succeeding sub-claims.

Figure 1:
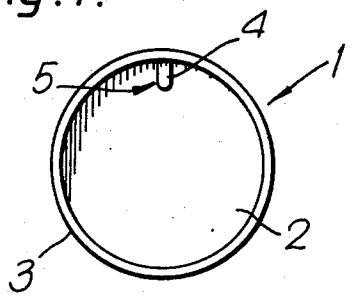
Figure 2:
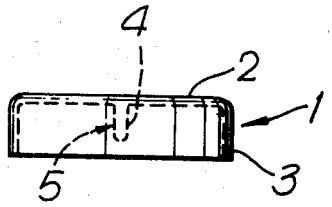
Figure 3:
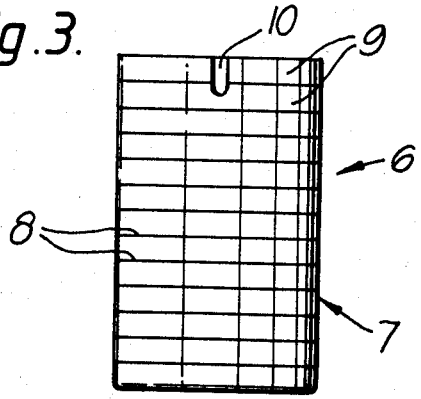

Embodiment examples of the invention will be described further in the following with reference to the accompanying drawings, where FIGS. 1 and 2, respectively, show a lid for a can of ski wax seen from the bottom and from the side, and FIG. 3 shows a side view of a ski wax can provided with peripheral, parallel score lines, showing also the cut made in the upper margin of the casing when the lid of the invention was placed on the can.

Figure 4A:
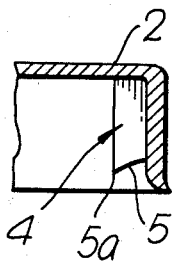

FIGS. 4*a* and *b*, 5*a* and *b*, and 6*a* and *b* show different embodiments of the lid with the cutting/severing means.

As a rule, ski wax cans are cylindrical, but they can of course have any other cross-sectional configuration considered suitable. In the drawings, the conventional cylindrical type is illustrated, and FIG. 1 shows a conventional lid 1 seen from below, comprising a flat base 2 and a surrounding skirt 3, as well as the characteristic feature of the invention, a projection 4 which is preferably attached both to the interior of the skirt 3 and to the interior of the lid bottom 2. The edge of the projection 4 which faces away from the bottom of the lid is provided with a sharp edge or knife edge 5, which in the present case is indicated as the edge lying between one side edge of the projection and its upper edge. In other words, the angle between these said edges should be an acute angle. However, it is clear that the cutting edge 5 can also be provided by having the two opposing sides of the projection incline toward one another to form a sharp edge, or each side edge can be provided with an upper facet, the facets together forming the desired edge. FIG. 2 shows the lid of FIG. 1 with the projection 4 and cutting edge 5 seen from the side, the projection 4 being indicated by dashed lines. FIG. 3 shows the can 6; the casing 7 has been provided with parallel, circumferential score lines 8 to facilitate the tearing off of strips 9 from the outer end of the casing 7 in order thereby to expose non-liquid wax. A cut 10 has been produced in the upper margin of the casing 7 by means of the projection 4 with the cutting edge 5 provided in the lid 1, the cut being made as the lid 1 was placed on the can. When the lid is being placed on the can, one need only apply a small extra pressure over that portion of the lid in which the projection is located, causing the knife edge 5 to cut down into the outer margin of the casing 7. The minimum distance between the cutting edge 5 and the bottom 2 of the lid is preferably somewhat greater than the distance between the score lines 8 in the casing, such that the cut 10 so produced severs the outer strip 9 completely, permitting the strip to be torn off easily.

Figure 4B:
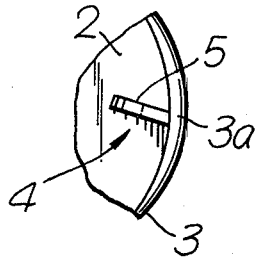

To ensure that the knife edge 5 actually does cut the outer end of the casing 7, the projection 4 with the cutting edge 5 is preferably attached both to the skirt 3 and to the base 2 of the lid, as shown clearly in FIGS. 4*a* and 4*b*, so that the projection will be very rigid. In addition, the edge 5 projects diagonally outwards from the skirt 3 and diagonally away from the bottom 2 of the lid, such that the outer end 5a of the cutting edge 5 is farther from the bottom 2 of the lid than the rest of the edge 5. Owing to the above configuration, when the lid 1 is placed on the can 6, the outer end 5*a* of the cutting edge 5 will cut into the outer surface of the wax, passing through the wax until it comes into contact with the outer rim of the casing 7; as the lid is then pressed further onto the can 6, the outer edge on the can will slide along the cutting edge 5 toward the interior of the skirt and the final cut occurs, the exterior side of the casing being held against and sliding inwardly along the interior surface of the skirt. By placing the projection 4 at a somewhat acute angle in relation to the adjacent skirt section, as shown in FIG. 4*b*, i.e., such that the projection diverges from a radial direction in the lid, the projection 4 with the cutting edge 5, as the outer end of the casing is cut, will push one edge of the cut portion 10 somewhat inwards towards the interior of the can, thus making it easier for one to grasp the other cut edge portion and facilitating the tearing of the outer strip 9.

Figure 5A:
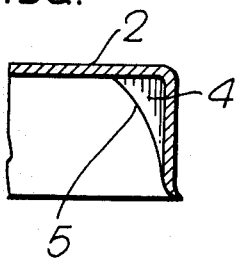
Figure 5B:
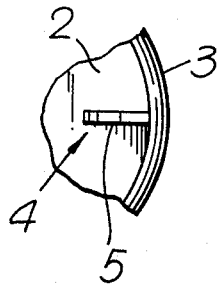

FIGS. 5*a* and 5*b* show an embodiment of the projection 4 in which the edge 5 is concavely curved and extends from the bottom 2 of the lid and forward to the outer edge of the skirt 3. With this embodiment, the lid can be placed on the can with the edge 5 against the edge of the casing 7, and the opposite edge of the lid is then pressed down over the can. One thereby obtains a cutting movement between the edge 5 and the outer edge of the casing, which produces the cut 10.

Figure 6A:
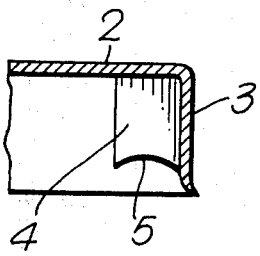
Figure 6B:
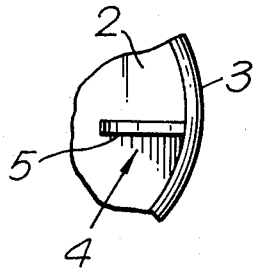

Another embodiment is shown in FIGS. 6*a* and 6*b*, where the projection 4 is provided with an outer, preferably concave cutting edge 5, whose purpose is to ensure that the outer edge of the casing 7 will slide against the lowest section of the cutting edge 5 as the cut 10 is made.

However, the embodiment which is the most practical and preferred is the one shown in FIGS. 4*a* and 4*b*. As shown in FIGS. 4*a* and *b*, the skirt section 3*a* adjacent to the projection 4 can be somewhat thicker than the remainder of the skirt, thus reinforcing the projection 4 such that it will not resiliently bend aside when the lid 1 is placed on the can 6; in this way, a good cutting effect is ensured.

Having described our invention, we claim:

1. A lid arrangement for a ski wax can with a tear-off casing, said lid comprising a bottom surrounded by a peripheral skirt adapted to lie against the exterior of the casing, characterized in that a sharp edge or knife edge is arranged on the interior of the lid at its skirt and facing away from the bottom of the lid, said edge or knife edge producing a cut in the upper edge of the can casing when the lid is placed on the can.

2. A lid arrangement according to claim 1, characterized in that the cutting edge is disposed on a projection attached to the skirt and the bottom of the lid.

3. A lid arrangement according to claim 1, characterized in that the end of the cutting edge farthest away from the skirt is located at a greater distance from the bottom of the lid than the rest of the edge.

4. A lid arrangement according to claim 2, characterized in that the projection forms an acute angle with the tangent of its adjacent skirt section.

5. A lid arrangement according to claim 2, characterized in that the skirt section adjacent to the projection is more rigid than the rest of the skirt portion.

6. A lid arrangement according to claim 2, characterized in that the edge is concavely curved.

7. A lid arrangement according to claim 6, characterized in that the ends of the cutting edge are spaced farther from the bottom of the lid than the middle section of the edge.

8. A lid arrangement according to claim 1, characterized in that the distance from the edge to the bottom of the lid at the skirt is at least as great as the distance between peripheral parallel score lines provided in the casing for tearing purposes.

9. An assembly of a lid and an open-ended tubular casing constructed of tearable material such that the material at the upper end of the casing can be manually stripped away to expose the contents of the casing, the lid being removably fitted to the end of the casing solely by relative longitudinal movement, the lid comprising a bottom surrounded by a peripheral skirt which lies against the exterior of the casing when the lid is in place and further comprising a knife within the lid and carried thereby, the knife lying in a plane which is parallel to the axis of the lid, the knife further having a cutting edge facing away from said bottom and being located such that said edge produces a single axial cut in the casing at its open end as the lid is fitted to the casing.

10. An assembly as in claim 9 wherein said knife lies in a linear plane which makes an acute angle with said skirt, said knife being in contact with said skirt and with said lid bottom and the portion of said skirt adjacent said knife being thicker than the remainder of said skirt thus increasing the resistance of said knife to bending when it cuts said casing.

* * * * *